US006029320A

United States Patent [19]

Monneret et al.

[11] Patent Number: 6,029,320

[45] Date of Patent: Feb. 29, 2000

[54] STRAND ADJUSTING MECHANISM IN A FOLDING CLASP FOR A BRACELET

[75] Inventors: Alain Monneret, Villard St Sauveur; Thierry Lalanne, Echenevex, both of France

[73] Assignee: Maier S.A., Saint-Claude, France

[21] Appl. No.: 08/976,310

[22] Filed: Nov. 21, 1997

[30] Foreign Application Priority Data

Nov. 22, 1996 [FR] France ..... 96 14557

[51] Int. Cl.[7] ..... A44C 5/24

[52] U.S. Cl. ..... 24/170; 24/265 WS; 24/71 J

[58] Field of Search ..... 24/71 J, 265 WS, 24/265 EC, 265 BC, 265 B, 71 R, 70 J, 68 J, 69 J, 68 E, 68 T, 616, 625, 170, 191

[56] References Cited

U.S. PATENT DOCUMENTS 1,612,395 12/1926 Osborne ..... 24/71 J
1,829,675 10/1931 Roy ..... 24/71 J
5,485,659 1/1996 Kashikie et al. ..... 24/71 J

FOREIGN PATENT DOCUMENTS 665 536 5/1988 Switzerland .
2 293 620 4/1996 United Kingdom .

*Primary Examiner*—James R. Brittain
*Assistant Examiner*—Robert J. Sandy
*Attorney, Agent, or Firm*—Henderson & Sturm LLP

[57] ABSTRACT

A strand adjusting mechanism (5) in a folding clasp (1, 2) for bacelets, this mechanism comprising a buckle (40) mounted pivotally round a transverse rotational shaft (20) at the end of one of the blades (1) of the clasp and a tongue (30) mounted pivotally round the same shaft (20) as the buckle. The tongue and/or the end of the blade have one or more stops (16, 34) limiting the rotation of this tongue between a raised position orthogonal to the end of the blade and a lowered position in the extension of the blade. In addition, the upper cross bar of the buckle has a subjacent front wall (46) capable of abutting against the free end of the tongue.

5 Claims, 3 Drawing Sheets

STRAND ADJUSTING MECHANISM IN A FOLDING CLASP FOR A BRACELET

BACKGROUND OF THE INVENTION

The present invention relates to a folding clasp for a flexible bracelet of which the length of one of the strands can be adjusted by a mechanism for adaptation to the size of the wearer's wrist. In these clasps, the adjustable strand is connected to a first folding blade by the mechanism using one of the strand adjusting orifices, the other, stationary strand being connected by a fastener to the end of the base blade of the clasp either directly or by means of a second folding blade. The blades, also known as folding arms, are connected to one another by rotational shafts in the manner of hinges.

A first type of mechanism comprises a base plate articulated to the end of its folding blade as well as a cap having a cross section in the form of an inverted U extending beyond the base plate. The two edges of one of the ends of the cap are rotatably mounted on the lateral faces of the corresponding end of the base plate, and the free edges of the other end of the cap can be locked by lateral removable means on the lateral faces of the base plate. The adjustable strand passing between the base plate and the cap is held by a stud protruding from the internal face of this base or from the cap when the base or cap is closed on the plate. Such mechanisms are described, for example, in the documents U.S. Pat. No. 1,619,138, CH 632 332, FR 2 699 796 or GB 2 278 148. However, these mechanisms may be too bulky in appearance once closed.

A second type of mechanism comprises a buckle, or loop, having an internal cross section which is slightly greater than that of the strand and which is pivotally mounted on a shaft located at the end of the folding blade. This shaft can be held in cylinders attached to the end of the blade, the shaft or the cylinders constituting the lower cross bar of the buckle, if desired. A central tongue barring the interior of the buckle is also pivotally mounted on this same shaft. Once the adjustable strand has passed into the buckle, the tongue is engaged in one of the adjustment orifices in the strand, then locked in the buckle. This type of mechanism has the advantage of comprising fewer parts, of being more discreet and of resembling a known belt buckle which is simple for the public. However, it is helpful if the tongue can be retracted when the strand is introduced into the buckle and can also be retained in the buckle so as to keep the adjustable strand correctly in the clasp once the clasp has been closed and locked.

The document CH 665 536 discloses such a mechanism in which the tongue can pivot freely forward in the direction of the stationary strand, that is downstream with reference to the direction of insertion of the strand in the buckle, for retraction, but is held toward the rear in the transverse plane of the buckle due to the engagement of its upper end in a recess made in the internal face of the upper cross bar and open downstream. In other words this upper cross bar of the buckle has a lower groove ending with an internal vertical rear wall which prevents the tongue from rocking further upstream.

The document GB 2 293 620 also discloses a mechanism of this type in which the tongue can pivot forwards. On the other hand, the tongue in this mechanism is held in the front transverse plane of the buckle by latching of its upper end in a spherical cap-shaped recess provided in the internal face of the upper cross bar of the buckle.

However, if the initial adjustment of the bracelet is too long, the user may pull on the adjustable strand and advance it relative to the locked clasp which he is also holding. There is therefore a risk that the tongue will rock sufficiently far forwards to leave the orifice in the strand which it is momentarily holding by jamming but which it then releases without the wearer's knowledge owing to vibrations. This risk of the tongue leaving the strand at an inopportune moment is greater if the user merely pulls this strand obliquely in order to open the clasp. There is nothing to prevent the strand from moving back and then leaving the buckle, which may cause the loss of a valuable watch.

SUMMARY OF THE INVENTION

The present invention relates to an improved strand adjusting mechanism in a folding clasp, this mechanism comprising a clasp mounted so as to pivot round a transverse rotational shaft at the end of one of the blades of the clasp as well as a tongue mounted pivotally round the same shaft as the buckle and capable of barring the centre of the passage of the buckle. In particular, the locking of the adjustable strand by this mechanism must be particularly secure and reliable whatever the pulls likely to be applied to this strand. This mechanism should preferably be composed of a limited number of parts which are simple to manufacture in order accordingly to reduce the production cost. This mechanism should also be easy to use and discreet in appearance.

According to the invention, these objects are achieved in that the tongue and/or the end of the blade have one or more stops limiting the rotation of this tongue between a raised position orthogonal to the end of the blade and a lowered position in the extension of the blade and in that the upper cross bar of the buckle has a subjacent front wall capable of abutting against the free end of the tongue. The term front wall denotes a wall on the downstream side of the buckle as viewed relative to the direction of insertion of the strand in the buckle.

Therefore, when the tongue which passes through an orifice in the adjustable strand is raised at the same time as the buckle above the end of the folding blade and the folding blade is folded back and locked on its base blade, it is noted that this strand is held particularly reliably by the clasp. In fact, if an upstream pull is exerted on the strand, the stops prevent rotation of the tongue in this direction and the tongue securely holds the strand. On the other hand, if the strand is pulled downstream, the front wall holds the end of the tongue and therefore the strand, even if a strong pull is applied to open the clasp.

On the other hand, to alter the length of the bracelet, the buckle and the tongue merely have to be rocked forward after the clasp has been opened, thus bringing the adjustable strand perpendicularly to the end of the blade and the tongue then has to be effortlessly raised by removing it from the first orifice and reinserting it in another orifice, and everything then has to be folded backwards. The fact that the tongue can only leave the strand after opening the clasp on the one hand and rocking the buckle/tongue horizontally (therefore the strand vertically) on the other hand provides great security against accidental loss of the watch or jewellery.

In other words, the direction of closure of the tongue relative to its buckle has been reversed in this mechanism according to the invention in comparison with the aforementioned prior art mechanisms. This means that the wall of the buckle intended to stop the tongue can now be on the downstream side at the position where the pull is strongest during opening of the clasp by a mere pull on the strand, the stops holding it in the opposite direction.

According to a first embodiment, the shaft of the buckle is held by lateral shoulders or cylinders beneath the end of the blade either in front of or beneath a notch made in the end of the blade, and the tongue is extended beyond its rotational shaft by a stop or other protuberance or equivalent projection.

Now the front edge of the end of the blade facing the tongue prevents it from turning upstream beyond its vertical position orthogonal to the blade, and the lower face of the end of the blade against which the stop protuberance rests prevents this tongue from turning downstream beyond its retracted position in the extension of the blade. With this embodiment, the passage orifice for the shaft merely has to be positioned at one fifth of the length of the tongue from its lower end.

According to a second embodiment, the shaft of the buckle is held in front of the end of the blade or in a notch made in this end. The front face of the tongue is extended beyond its rotational shaft by a first stop, and its anterior face has a second substantially orthogonal stop, for example in the form of a protuberance or a pawn.

Now the first stop coming to rest against the lower face of the end of the blade prevents the tongue from turning downstream beyond its retracted position in the extension of the blade whereas the second stop resting on the upper face of the end of the blade prevents it from turning upstream beyond its orthogonal vertical position where it locks the strand. However, this embodiment assumes that two stops are produced on the tongue. The second stop can be utilised to facilitate insertion of the tongue in an orifice in the adjustable strand.

According to a third preferred embodiment, the shaft of the buckle is held by lateral shoulders or cylinders above the end of the blade, and the anterior face of the tongue has a substantially orthogonal stop or heel in the region of the shaft.

The lower part of the front face of the tongue rests directly against the upper face of the end of the blade when this tongue is in the retracted position, and the anterior stop of the tongue rests on this same upper face when this tongue is in the raised locked position of the buckle. In practice, this type of wedged tongue is relatively simple to machine, and the rear stop also constitutes a lever for the user's nail when he wishes to push the tongue into an orifice in the adjustable strand.

It should be noted that the clasp structures described hereinbefore are suitable not only for production by machining metal in the conventional manner but also for mass production by moulding of thermoplastic material.

The internal face of the upper cross bar of the buckle advantageously has a depression for latching of the free end of the tongue just behind the front wall. Therefore, the tongue is advantageously produced from an elastically deformable material to facilitate its engagement in the depression, therefore its latching. This material can be a spring steel or polymer.

This possibility of latching the tongue in the buckle on the one hand imparts better rigidity to this mechanism in the locked state and on the other hand gives a clear, audible indication of the good installation of the tongue in the buckle after the strand has been inserted.

According to an advantageous embodiment, the buckle is formed by a U-shaped cap associated with a rotational shaft held by cylinders or lateral walls integral with the end of the folding blade.

The number of parts constituting the mechanism is therefore reduced, these parts being either commercially available or easy to machine.

The buckle with its front wall and its latching depression or other complementary shapes for locking of the tongue in the buckle are preferably produced by a process involving injection of plastics material or metal powder (PIM). As used herein, "PIM" refers to powder injection moulding.

BRIEF DESCRIPTION OF THE DRAWINGS

The invention will be understood better by means of embodiments given as non-limiting examples and illustrated in the accompanying drawings.

DETAILED DESCRIPTION OF THE DRAWINGS

Figure 2:
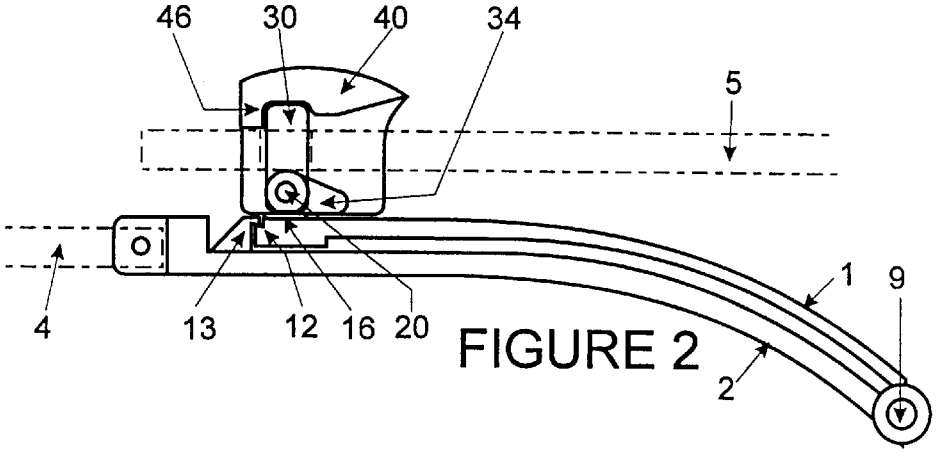
FIG. 2 is a longitudinal section of the mechanism in FIG. 1 mounted on a folding clasp.

As illustrated in FIG. 2, a clasp for a flexible bracelet, that is of leather, plastic or metal links, comprises a folding upper blade 1 articulated at one of its ends by a hinge 9 to the corresponding end of a base blade 2. The other end of the folding blade 1 can be fastened and removed as desired in the region of the other corresponding end of the base blade 2. For example, and as illustrated, the free front end of this folding blade has a groove 12 in which there engages a hook 13 integral with the upper face of the base blade. A clasp of this type allows the two strands 4, 5 of a bracelet to be joined at one of their ends, the other two ends being connected to a watch or a jewel. More particularly, a so-called stationary strand 4 is connected by a fastener to the free end of the base blade 2 (that is the end remote from that of the hinge 9), whereas the other so-called adjustable strand 5 is connected to the free end of the folding blade 1 by a mechanism for adjusting the length of the bracelet comprising a buckle 40 associated with a tongue 30.

Figure 1:
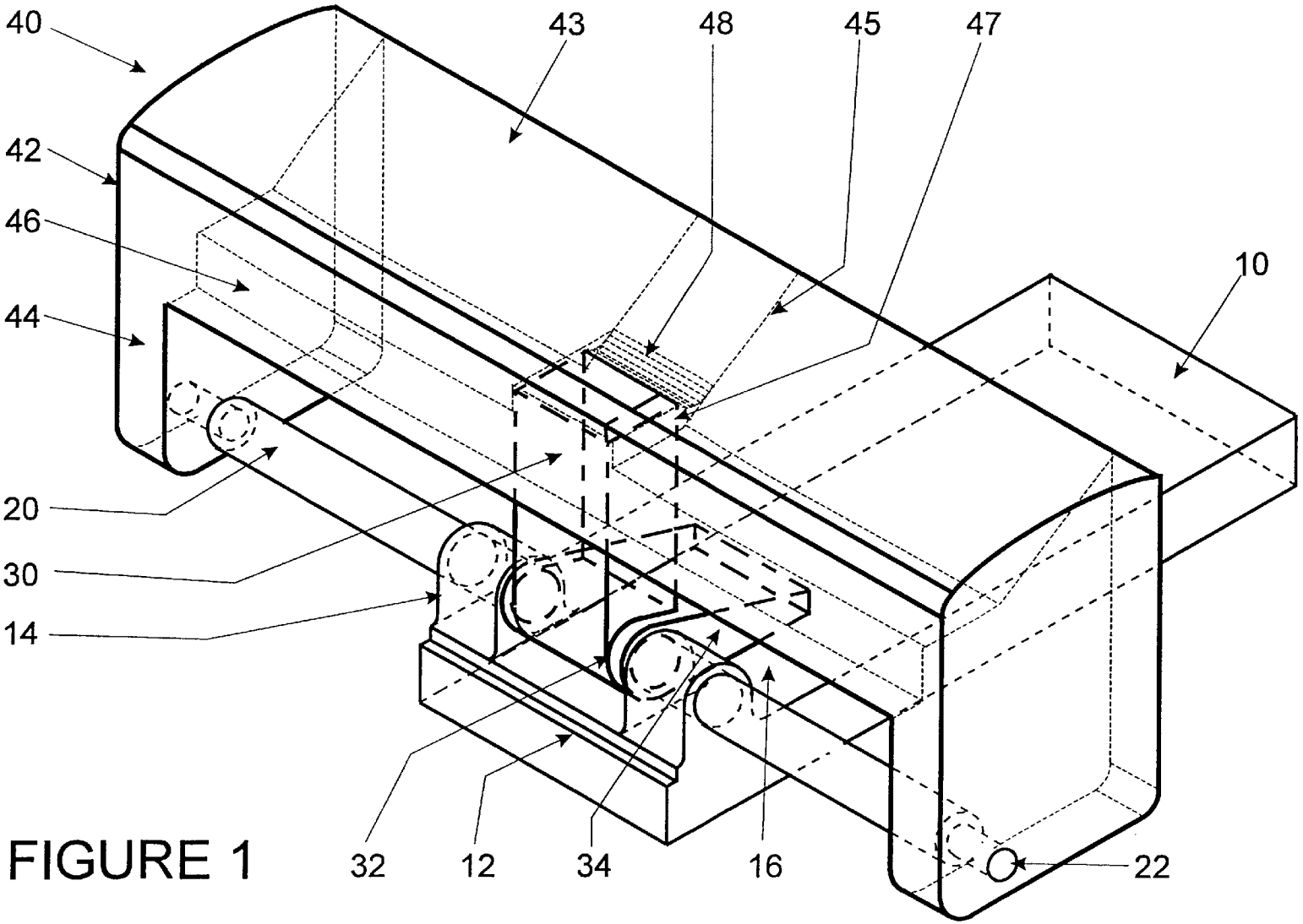
FIG. 1 is a perspective view of a first embodiment of a mechanism for adjusting the strand length according to the invention.

As shown more clearly in FIG. 1, the free end 10 of the folding blade has, just behind the fastening groove 12, two lateral fixing cylinders 14 provided above the upper surface 16, or seat, of this end 10.

Attached to these fixing cylinders is a pivoting buckle 40 which, as illustrated, is formed by a U-shaped cap 42 comprising an upper cross bar 43 and two lateral branches 44 of which the lower edges are articulated to the ends of a stationary rotational shaft 20 force-fitted in the fixing cylinders 14, this rotational shaft constituting the lower cross bar of the buckle 40. In particular, this shaft 20 engages with ferrules 22 of reduced diameter on either side in the lower edges of the lateral branches 44. This reduction in diameter ensures that the U-shaped cap remains aligned with the shaft.

More particularly according to the invention, the cross bar 43 has a vertical wall 46 on its front lower edge, that is its downstream edge as considered relative to the direction of introduction of the adjustable strand which, in the case shown in FIG. 1, takes place from right to left. The height of this vertical front wall 46 is between 1/10 and 1/3 of the height of the lateral branch 44.

Conversely, the upstream lower edge of the cross bar 43 has the form of a horizontal face 45 or a slightly oblique face having small angle of attack, that is of the order of 2 to 20 degrees relative to the horizontal and orientated outwardly. The central part of this lower face of cross bar 43 has, in its centre, a latching recess 47 which is separated from the oblique upstream face 45 by an inlet bead 48. For example, this latching recess can be produced by perforation. Alternatively, this recess 47 and this bead 48 are machined over the entire width of the cross bar, that is from one lateral branch 44 to the other. The entire buckle 40 is preferably injection moulded from metal by the so-called PIM method, also referred to as powder injection moulding.

Associated with this buckle 40, this adjusting mechanism also comprises a tongue 30 mounted on the rotational shaft 20 between the two lateral fixing cylinders 14. The height of this tongue 30 is such that its free upper end is designed to engage in the latching recess 47 after having passed over the inlet bead 48 as the result either of slight upward deformation of the cross bar 43, but preferably as the result of slight bending of this tongue which is produced from a relatively elastic material.

More particularly according to the invention, this tongue 30 has a heel stop 34 which is orientated upstream and is located in the region of the rotational shaft 20. This heel stop 34 forms cylinders 32 on either side of the tongue 30 which cover the rotational shaft 20. As illustrated, this heel stop 34 is designed to rest flat on the upper face 16 or seat of the end of the blade 10 when the tongue 30 is orientated vertically, its free end being engaged in the recess 47 in the buckle.

The method of using the mechanism for adjusting the length of the arm 5 described hereinbefore in relation to FIGS. 1 and 2 will now be explained with reference to FIGS. 3*a* to 3*k*.

Figure 3:
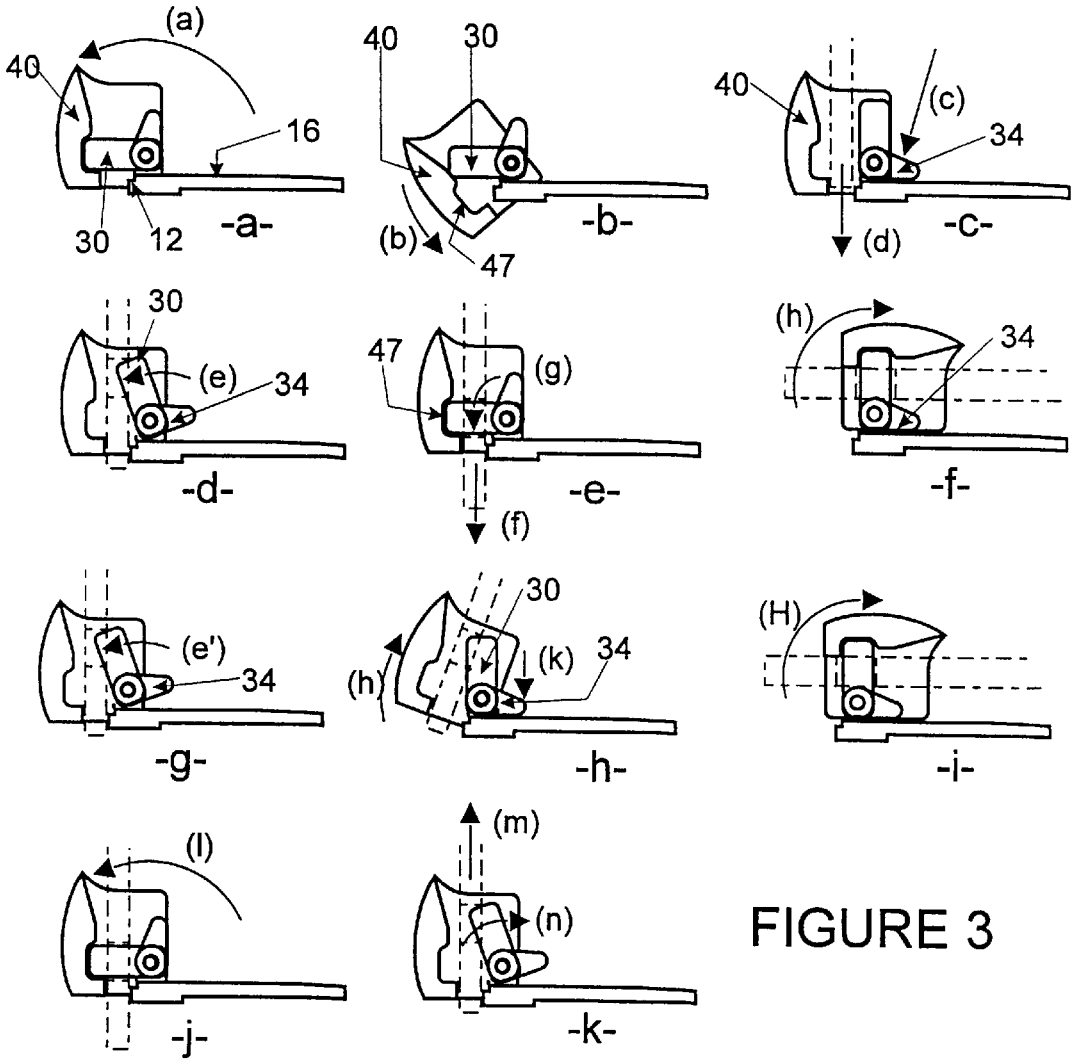
FIGS. 3*a* to 3*k* are longitudinal sections of the mechanism in FIG. 1 during the various stages of use.

To open the mechanism in order to insert the adjustable strand therein, the clasp should first be opened, allowing the buckle 40 and the latched tongue 30 only to rock forwards with a downstream rotation (a) as illustrated in FIG. 3*a*. After a rotation (a) of a quarter of a turn, the front face of the tongue 30 abuts flat against the upper face 16 of the blade close to the groove 12. Then, by forcing the buckle 40, an additional rotation thereof can be induced (b), allowing the free end of the tongue 30 to be released easily from the recess 47 in the buckle, as illustrated in FIG. 3*b*. the tongue then merely has to be raised vertically, for example by acting on the heel stop 34 with a nail and exerting a pressure thereon (c), as illustrated in FIG. 3*c*. As the passage in the buckle 40 is free, the adjustable arm 5 can be inserted by vertical translation (d).

Two methods allow the adjustable strand to be locked in the mechanism. According to the first method illustrated in FIGS. 3*d* to 3*f*, the end of the tongue 30 is first engaged in one of the orifices in the strand by causing it to pivot downstream with a rotation (e), for example by inserting a nail beneath the heel strap 34 which can thus be raised. With reference to FIG. 3*e*, the strand (f) should be pulled firmly so that it entrains the tongue in a rotation which is still directed downstream (g) until its end latches in the internal recess (47) in the buckle. The strand and the buckle with its latched tongue then merely have to be turned through a quarter of a turn upstream (h), to cause the stop 34 to rest on the upper face of the blade, this position illustrated in FIG. 3*f* merely allowing this clasp to be closed by engaging the groove 12 in the hook 13 of the base blade 2.

The second method, illustrated in FIGS. 3*g* to 3*i*, also involves first engaging the free end of the tongue in one of the orifices in the strand by a downstream rotation (e') by inserting a nail beneath the heel stop 34 according to FIG. 3*g*. In contrast to the previous method, the following stage involves raising the buckle/tongue/strand assembly by a first upstream rotation (h) to cause the heel stop 34 of the tongue 30 to rest on the upper face of the blade, as illustrated in FIG. 3*h*. It is then sufficient to force the complementary upstream rotation (H) of the buckle so as to bring its upper cross bar above the tongue, which is itself rotationally engaged by the bearing of its stop, until the free end of this tongue engages in the recess 47, as illustrated in FIG. 3*i*.

It should be noted that the user is advised of the engagement of the tongue in the buckle during the stages in FIGS. 3*e* and 3*i* when he hears a clicking sound and feels effective resistance.

When the clasp is closed, as illustrated in FIG. 2, it is noted that a pull exerted downstream on the strand 5 is compensated by the reaction of the front wall 46 of the buckle 40 on the upper end of the tongue 30. Conversely, an upstream pull exerted on the adjustable strand 5 inducing an upstream torque in the tongue 30 is compensated by the heel stop 34 resting on the upper face of the end of the blade 1, this bearing creating a resistive torque in the opposite direction.

To change the length of the bracelet, the clasp should first be opened and the adjustable strand and the buckle containing the tongue should then be rocked forward in a rotation (l) as shown in FIG. 3*j*, the heel stop of the tongue thus being in the vertical position. Thus, while holding the buckle on the one hand, a pull (m) is exerted on the upstream part of the strand on the other hand, causing disengagement of the tongue from the buckle by a rotation (n) according to FIG. 3*k*. After having selected the new desired strand orifice, the mechanism is closed by one of the methods described with reference to FIGS. 3*d* to 3*f* or 3*g* to 3*i*.

The invention is not strictly limited to the embodiment described hereinbefore, but encompasses numerous variations.

Figure 4:
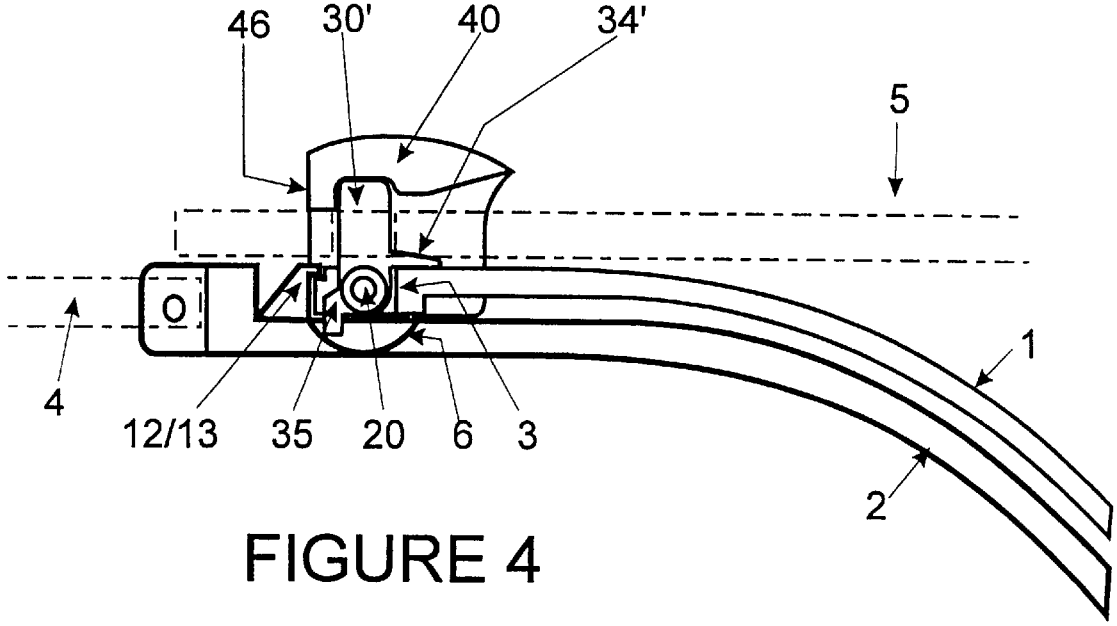
FIG. 4 is a longitudinal section of a second embodiment of a mechanism according to the invention.

According to a second embodiment shown in FIG. 4, the shaft 20 of the tongue 30' can be located in the thickness of the end of the folding blade 1, the base of the tongue thus being accommodated in a median notch 3 provided in this end of the blade. The anterior (upstream) face of the tongue 30' is thus completed by a rear heel stop 34' located just above the rotational shaft 20 which, as before, rests on the upper face of the end of the blade once this tongue is raised vertically, that is orthogonally to this end. This tongue 30' also comprises a second stop 35 extending the front face and capable of resting against the lower face of the end of the blade 1 once this tongue has been rocked by a quarter turn downstream and is therefore located directly in the extension of this blade. In this variation, a perforation should be provided in the centre of the base blade 2 just upstream of its hook 13 to accommodate the stop 35 when the clasp is locked, as illustrated.

Figure 5:
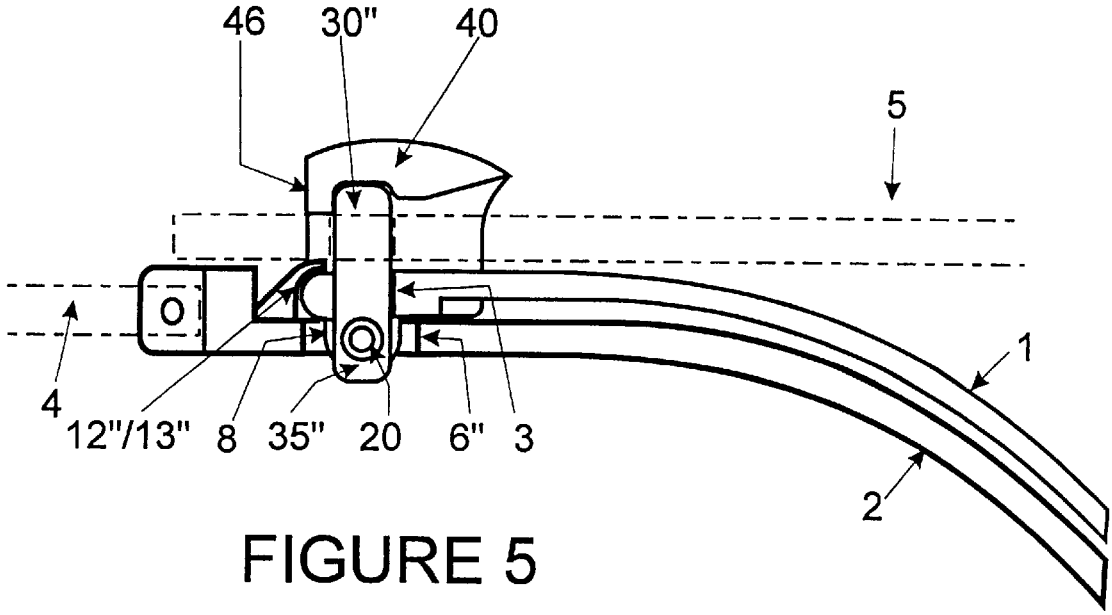
FIG. 5 is a longitudinal section of a third embodiment of a mechanism according to the invention.

According to a third embodiment illustrated in FIG. 5, the shaft 20 can be held below the end of the folding blade 1 on either side by lateral shoulders 8 integral with the blade, the buckle 40 still being articulated to this same shaft 20. The tongue 30" is thus shifted downwards relative to its shaft 20 to reveal a lower stop 35". This tongue 30" vertically traverses a central notch 3 provided in the centre of the end of the folding blade 1. To accommodate this arrangement, an opening 6" is provided in the centre of the base blade 2 just upstream of its hook 12" associated with a rounded end 13" of the folding blade 1. This arrangement resembles that described in the document GB 2 293 620, apart from the fact that the tongue has a lower heel stop 35" and the fact that the buckle 40 has a front vertical stop wall 46.

As can easily be understood, the tongue 30" is thus prevented from upward rotation beyond its vertical position by resting against the front edge at the bottom of the notch 3. Furthermore, this tongue 30" is prevented from downstream rotation beyond its horizontal position by the lower stop 35" resting against the lower face of the end of the folding blade 1.

The various embodiments can be produced either from machined metal parts or from injection moulded plastic parts. Although these mechanism do not comprise more parts than previously known mechanism, the mechanism according to the invention is particularly rigid and reliable once closed.

What we claim is:

1. A strand adjusting mechanism in a folding clasp for a bracelet having an upper blade hinged to a base blade, the mechanism comprising a U-shaped buckle having an upper cross bar and two lateral branches articulated to a transverse rotational shaft at the end of one of the blades of the clasp as well as a tongue mounted pivotally to said shaft, in which the tongue engages in one orifice of an adjustable strand inserted between the buckle and the shaft to adjust the length of the bracelet, wherein the tongue and/or the end of the upper blade have one or more stops limiting the rotation of this tongue between a raised position orthogonal to the end of the upper blade and a lowered position aligned with the end of the direction of insertion of the adjustable strand, the upper cross bar extends by a lower wall perpendicular to it and capable of abutting against the tongue.

2. Adjusting mechanism according to claim 1, wherein the shaft is held by lateral shoulders or cylinders above the end of the upper blade and wherein an upstream face of the tongue relatively to the direction of insertion of the adjustable strand has a substantially orthogonal stop articulated to said shaft.

3. The strand adjusting mechanism according to claim 1, wherein the shaft is held in front of the end of the upper blade or in a notch provided in this end, wherein a downstream face of the tongue relatively to the direction of introduction of the adjustable stand is extended beyond said rotational shaft by a first stop and wherein an upstream face has a substantially orthogonal second stop.

4. The strand adjusting mechanism according to claim 1, wherein the shaft is held by lateral shoulders or cylinders beneath the end of the upper blade either in front of or beneath a notch provided in the end of the upper blade, and wherein the tongue is extended beyond said rotational shaft by a stop.

5. The adjusting mechanism according to claim 1, wherein along a direction perpendicular to the upper cross bar, the wall has a height between 1/10 and 1/3 of the height of the lateral branches.

* * * * *